US009691349B2

(12) United States Patent
Tripathi et al.

(10) Patent No.: US 9,691,349 B2
(45) Date of Patent: Jun. 27, 2017

(54) SOURCE PIXEL COMPONENT PASSTHROUGH

(71) Applicant: Apple Inc., Cupertino, CA (US)

(72) Inventors: Brijesh Tripathi, Los Altos, CA (US); Peter F. Holland, Los Gatos, CA (US); Guy Cote, San Jose, CA (US)

(73) Assignee: Apple Inc., Cupertino, CA (US)

( * ) Notice: Subject to any disclaimer, the term of this patent is extended or adjusted under 35 U.S.C. 154(b) by 55 days.

(21) Appl. No.: 14/676,544

(22) Filed: Apr. 1, 2015

(65) Prior Publication Data

US 2016/0293137 A1 Oct. 6, 2016

(51) Int. Cl.

| | |
|---|---|
| ***G09G 5/02*** | (2006.01) |
| ***G09G 5/36*** | (2006.01) |
| *G09G 5/391* | (2006.01) |

(52) U.S. Cl.

CPC ..... *G09G 5/02* (2013.01); *G09G 5/363* (2013.01); *G09G 5/391* (2013.01); *G09G 2340/0428* (2013.01); *G09G 2360/02* (2013.01)

(58) Field of Classification Search

CPC ..... G09G 5/02; G09G 2340/06; G09G 5/391; H04N 1/60; G06F 9/3826; G06F 9/3828; G06T 1/20

See application file for complete search history.

(56) References Cited

U.S. PATENT DOCUMENTS

| | | | | |
|---|---|---|---|---|
| 4,860,248 | A * | 8/1989 | Lumelsky | G06T 1/20 345/502 |
| 6,803,922 | B2 | 10/2004 | Marino | |
| 7,126,614 | B2 | 10/2006 | Leyvi | |
| 7,995,069 | B2 | 8/2011 | Van Hook et al. | |
| 8,212,836 | B2 * | 7/2012 | Matsumoto | G06T 11/001 345/549 |
| 2013/0070844 | A1 | 3/2013 | Malladi et al. | |

* cited by examiner

*Primary Examiner* — Antonio A Caschera
(74) *Attorney, Agent, or Firm* — Rory D. Rankin; Meyertons, Hood, Kivlin, Kowert & Goetzel, P.C.

(57) ABSTRACT

Systems, apparatuses, and methods for passing source pixel data through a display control unit. A display control unit includes N-bit pixel component processing lanes for processing source pixel data. When the display control unit receives M-bit source pixel components, wherein 'M' is greater than 'N', the display control unit may assign the M-bit source pixel components to the N-bit processing lanes. Then, the M-bit source pixel components may passthrough the pixel component processing elements of the display control unit without being modified.

20 Claims, 9 Drawing Sheets

500

8-Bit RGB

| RED [7:0] | | | | | | | | GREEN [7:0] | | | | | | | | BLUE [7:0] | | | | | | | |
|---|---|---|---|---|---|---|---|---|---|---|---|---|---|---|---|---|---|---|---|---|---|---|---|
| R | R | R | R | R | R | R | R | G | G | G | G | G | G | G | G | B | B | B | B | B | B | B | B |

505

12-Bit YCbCr 4:2:2

| RED [7:0] | | | | | | | | GREEN [7:0] | | | | | | | | BLUE [7:0] | | | | | | | |
|---|---|---|---|---|---|---|---|---|---|---|---|---|---|---|---|---|---|---|---|---|---|---|---|
| Cx | Cx | Cx | Cx | Cx | Cx | Cx | Cx | Y | Y | Y | Y | Y | Y | Y | Y | Cx | Cx | Cx | Cx | Y | Y | Y | Y |

Cx [11:4] Y [11:4] Cx [3:0] Y [3:0]

FIG. 5

SOURCE PIXEL COMPONENT PASSTHROUGH

BACKGROUND

Technical Field

Embodiments described herein relate to the field of graphical information processing and more particularly, to processing source pixel data of varying formats and bit-widths.

Description of the Related Art

Part of the operation of many computer systems, including portable digital devices such as mobile phones, notebook computers and the like, is to employ a display device, such as a liquid crystal display (LCD), to display images, video information/streams, and data. Accordingly, these systems typically incorporate functionality for generating images and data, including video information, which are subsequently output to the display device. Such devices typically include video graphics circuitry (i.e., a display pipeline) to process images and video information for subsequent display.

In digital imaging, the smallest item of information in an image is called a "picture element," more generally referred to as a "pixel." For convenience, pixels are generally arranged in a regular two-dimensional grid. By using such an arrangement, many common operations can be implemented by uniformly applying the same operation to each pixel independently. Since each pixel is an elemental part of a digital image, a greater number of pixels can provide a more accurate representation of the digital image. To represent a specific color on an electronic display, each pixel may have three values, one each for the amounts of red, green, and blue present in the desired color. Some formats for electronic displays may also include a fourth value, called alpha, which represents the transparency of the pixel. This format is commonly referred to as ARGB or RGBA. Another format for representing pixel color is YCbCr, where Y corresponds to the luma, or brightness, of a pixel and Cb and Cr correspond to two color-difference chrominance components, representing the blue-difference (Cb) and red-difference (Cr).

Most images and video information displayed on display devices such as LCD screens are interpreted as a succession of ordered image frames, or frames for short. While generally a frame is one of the many still images that make up a complete moving picture or video stream, a frame can also be interpreted more broadly as simply a still image displayed on a digital (discrete or progressive scan) display. A frame typically consists of a specified number of pixels according to the resolution of the image/video frame. Most graphics systems use memories (commonly referred to as "frame buffers") to store the pixels for image and video frame information. The information in a frame buffer typically consists of color values for every pixel to be displayed on the screen. Color values are commonly stored in 1-bit monochrome, 4-bit palletized, 8-bit palletized, 16-bit high color and 24-bit true color formats. An additional alpha channel is oftentimes used to retain information about pixel transparency. The total amount of the memory required for frame buffers to store image/video information depends on the resolution of the output signal, and on the color depth and palette size. The High-Definition Television (HDTV) format, for example, is composed of up to 1080 rows of 1920 pixels per row, or almost 2.1M pixels per frame.

The source images which are processed may vary over time, in the type of format (e.g., ARGB, YCbCr) of the source image data, the downsampling ratio (e.g., 4:4:4, 4:2:2), the bit-width, and other characteristics. The bit-width may be defined as the number of binary digits, or bits, in each source pixel component (e.g., red pixel component, blue pixel component, luma pixel component). It can be challenging to process source pixel data of varying formats and bit-widths.

SUMMARY

Systems, apparatuses, and methods for processing various types of source pixel data are contemplated.

In one embodiment, an apparatus may include at least one display control unit for processing source pixel data and driving output frame pixels to one or more displays. In one embodiment, the display control unit may include a plurality of pixel component processing elements which only support pixel components with a bit-width of 'N' bits, wherein 'N' is an integer greater than one. In some embodiments, the display control unit may receive source pixel components with a bit-width of 'M' bits, wherein 'M' is greater than 'N'. In these embodiments, the display control unit may pass the source pixel data through the processing elements unmodified, or the display control unit may route the source pixel data on a bypass path around the processing elements.

In one embodiment, the display control unit may assign received source pixel data to the pixel component processing lanes of the display control unit when the bit-width of the received source pixel data is greater than the bit-width of the pixel component processing lanes. For example, in one embodiment, the display control unit may assign M-bit YCbCr 4:2:2 data to three N-bit pixel component processing lanes, wherein 'M' is greater than 'N'. Since YCbCr 4:2:2 data only has two components per pixel, either Y and Cb or Y and Cr, the received source image data may be assigned to fit across the three N-bit pixel component processing lanes.

The display control unit may include a color space converter unit for converting the color space of received source pixel data. For example, the color space converter unit may convert received source pixel data from the YCbCr color space into the RGB color space when the bit-widths of the source pixel components and pixel component processing lanes match. If the received YCbCr data is subsampled and if the bit-width of each received source pixel components is greater than the bit-width of each pixel component processing lane, the display control unit may notify the color space converter unit that the received source pixel data is RGB data to prevent the color space converter unit from performing a color space conversion on the received YCbCr data.

These and other features and advantages will become apparent to those of ordinary skill in the art in view of the following detailed descriptions of the approaches presented herein.

BRIEF DESCRIPTION OF THE DRAWINGS

The above and further advantages of the methods and mechanisms may be better understood by referring to the following description in conjunction with the accompanying drawings, in which:

FIG. 5 illustrates one embodiment of an arrangement for assigning 12-bit YCbCr 4:2:2 to 8-bit RGB pixel component processing lanes.

DETAILED DESCRIPTION OF EMBODIMENTS

Figure 1:
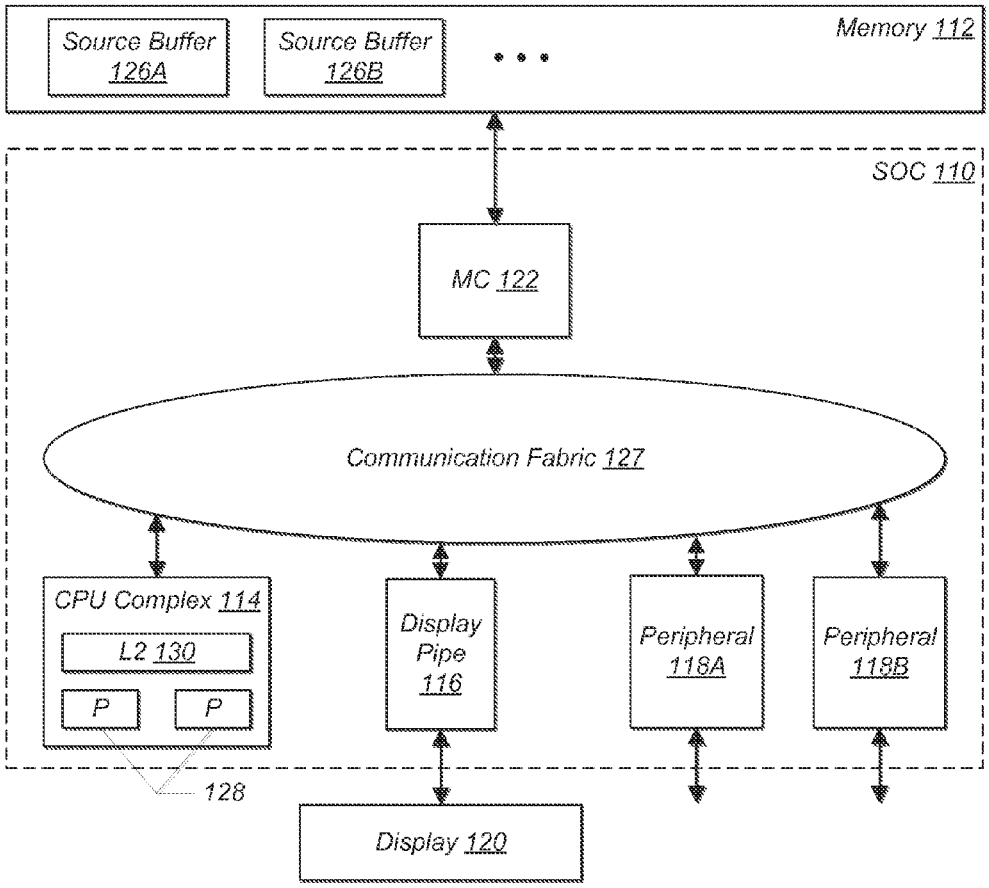
FIG. 1 is a block diagram illustrating one embodiment of a system on a chip (SOC) coupled to a memory and one or more display devices.

In the following description, numerous specific details are set forth to provide a thorough understanding of the methods and mechanisms presented herein. However, one having ordinary skill in the art should recognize that the various embodiments may be practiced without these specific details. In some instances, well-known structures, components, signals, computer program instructions, and techniques have not been shown in detail to avoid obscuring the approaches described herein. It will be appreciated that for simplicity and clarity of illustration, elements shown in the figures have not necessarily been drawn to scale. For example, the dimensions of some of the elements may be exaggerated relative to other elements.

This specification includes references to "one embodiment". The appearance of the phrase "in one embodiment" in different contexts does not necessarily refer to the same embodiment. Particular features, structures, or characteristics may be combined in any suitable manner consistent with this disclosure. Furthermore, as used throughout this application, the word "may" is used in a permissive sense (i.e., meaning having the potential to), rather than the mandatory sense (i.e., meaning must). Similarly, the words "include", "including", and "includes" mean including, but not limited to.

Terminology

The following paragraphs provide definitions and/or context for terms found in this disclosure (including the appended claims):

"Comprising." This term is open-ended. As used in the appended claims, this term does not foreclose additional structure or steps. Consider a claim that recites: "A system comprising a display control unit . . . " Such a claim does not foreclose the system from including additional components (e.g., a processor, a memory controller).

"Configured To." Various units, circuits, or other components may be described or claimed as "configured to" perform a task or tasks. In such contexts, "configured to" is used to connote structure by indicating that the units/circuits/components include structure (e.g., circuitry) that performs the task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. §112(f) for that unit/circuit/component. Additionally, "configured to" can include generic structure (e.g., generic circuitry) that is manipulated by software and/or firmware (e.g., an FPGA or a general-purpose processor executing software) to operate in a manner that is capable of performing the task(s) at issue. "Configured to" may also include adapting a manufacturing process (e.g., a semiconductor fabrication facility) to fabricate devices (e.g., integrated circuits) that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

Referring now to FIG. 1, a block diagram of one embodiment of a system on a chip (SOC) 110 is shown coupled to a memory 112 and display device 120. A display device may be more briefly referred to herein as a display. As implied by the name, the components of the SOC 110 may be integrated onto a single semiconductor substrate as an integrated circuit "chip." In some embodiments, the components may be implemented on two or more discrete chips in a system. However, the SOC 110 will be used as an example herein. In the illustrated embodiment, the components of the SOC 110 include a central processing unit (CPU) complex 114, display pipe 116, peripheral components 118A-118B (more briefly, "peripherals"), a memory controller 122, and a communication fabric 127. The components 114, 116, 118A-118B, and 122 may all be coupled to the communication fabric 127. The memory controller 122 may be coupled to the memory 112 during use. Similarly, the display pipe 116 may be coupled to the display 120 during use. In the illustrated embodiment, the CPU complex 114 includes one or more processors 128 and a level two (L2) cache 130.

The display pipe 116 may include hardware to process one or more still images and/or one or more video sequences for display on the display 120. Generally, for each source still image or video sequence, the display pipe 116 may be configured to generate read memory operations to read the data representing respective portions of the frame/video sequence from the memory 112 through the memory controller 122.

The display pipe 116 may be configured to perform any type of processing on the image data (still images, video sequences, etc.). In one embodiment, the display pipe 116 may be configured to scale still images and to dither, scale, and/or perform color space conversion on their respective portions of frames of a video sequence. The display pipe 116 may be configured to blend the still image frames and the video sequence frames to produce output frames for display. Display pipe 116 may also be more generally referred to as a display pipeline, display control unit, or a display controller. A display control unit may generally be any hardware configured to prepare a frame for display from one or more sources, such as still images and/or video sequences.

More particularly, display pipe 116 may be configured to retrieve respective portions of source frames from one or more source buffers 126A-126B stored in the memory 112, composite frames from the source buffers, and display the resulting frames on corresponding portions of the display 120. Source buffers 126A and 126B are representative of any number of source frame buffers which may be stored in memory 112. Accordingly, display pipe 116 may be configured to read the multiple source buffers 126A-126B and composite the image data to generate the output frame.

The format and bit-width of the source pixel data in source buffers 126A-126B may vary as the types of image data being processed vary over time. Display pipe 116 may be configured to determine the format and bit-width of the source pixel data and process, route, and/or assign the source pixel data to pixel component processing lanes based on the determined format and bit-width. In some cases, display pipe 116 may passthrough source pixel data unmodified if the bit-width of the source pixel data is greater than the bit-width of the pixel component processing lanes of display pipe 116. Additionally, in some embodiments, display pipe 116 may include a bypass path to convey received source pixel data on a path which bypasses the processing elements of display pipe 116.

The display 120 may be any sort of visual display device. The display 120 may be a liquid crystal display (LCD), light emitting diode (LED), plasma, cathode ray tube (CRT), etc. The display 120 may be integrated into a system including the SOC 110 (e.g. a smart phone or tablet) and/or may be a separately housed device such as a computer monitor, television, or other device. Various types of source image data may be shown on display 120. In various embodiments, the source image data may represent a video clip in a format, such as, for example, Moving Pictures Expert Group-4 Part 14 (MP4), Advanced Video Coding (H.264/AVC), or Audio Video Interleave (AVI). Alternatively, the source image data may be a series of still images, each image considered a frame, that may be displayed in timed intervals, commonly referred to as a slideshow. The images may be in a format such as Joint Photographic Experts Group (JPEG), raw image format (RAW), Graphics Interchange Format (GIF), or Portable Networks Graphics (PNG).

In some embodiments, the display 120 may be directly connected to the SOC 110 and may be controlled by the display pipe 116. That is, the display pipe 116 may include hardware (a "backend") that may provide various control/data signals to the display, including timing signals such as one or more clocks and/or the vertical blanking period and horizontal blanking interval controls. The clocks may include the pixel clock indicating that a pixel is being transmitted. The data signals may include color signals such as red, green, and blue, for example. The display pipe 116 may control the display 120 in real-time or near real-time, providing the data indicating the pixels to be displayed as the display is displaying the image indicated by the frame. The interface to such display 120 may be, for example, VGA, HDMI, digital video interface (DVI), a liquid crystal display (LCD) interface, a plasma interface, a cathode ray tube (CRT) interface, any proprietary display interface, etc.

The CPU complex 114 may include one or more CPU processors 128 that serve as the CPU of the SOC 110. The CPU of the system includes the processor(s) that execute the main control software of the system, such as an operating system. Generally, software executed by the CPU during use may control the other components of the system to realize the desired functionality of the system. The CPU processors 128 may also execute other software, such as application programs. The application programs may provide user functionality, and may rely on the operating system for lower level device control. Accordingly, the CPU processors 128 may also be referred to as application processors. The CPU complex may further include other hardware such as the L2 cache 130 and/or an interface to the other components of the system (e.g., an interface to the communication fabric 127).

The peripherals 118A-118B may be any set of additional hardware functionality included in the SOC 110. For example, the peripherals 118A-118B may include video peripherals such as video encoder/decoders, image signal processors for image sensor data such as camera, scalers, rotators, blenders, graphics processing units, etc. The peripherals 118A-118B may include audio peripherals such as microphones, speakers, interfaces to microphones and speakers, audio processors, digital signal processors, mixers, etc. The peripherals 118A-118B may include interface controllers for various interfaces external to the SOC 110 including interfaces such as Universal Serial Bus (USB), peripheral component interconnect (PCI) including PCI Express (PCIe), serial and parallel ports, etc. The peripherals 118A-118B may include networking peripherals such as media access controllers (MACs). Any set of hardware may be included.

The memory controller 122 may generally include the circuitry for receiving memory operations from the other components of the SOC 110 and for accessing the memory 112 to complete the memory operations. The memory controller 122 may be configured to access any type of memory 112. For example, the memory 112 may be static random access memory (SRAM), dynamic RAM (DRAM) such as synchronous DRAM (SDRAM) including double data rate (DDR, DDR2, DDR3, etc.) DRAM. Low power/mobile versions of the DDR DRAM may be supported (e.g. LPDDR, mDDR, etc.). The memory controller 122 may include various queues for buffering memory operations, data for the operations, etc., and the circuitry to sequence the operations and access the memory 112 according to the interface defined for the memory 112.

The communication fabric 127 may be any communication interconnect and protocol for communicating among the components of the SOC 110. The communication fabric 127 may be bus-based, including shared bus configurations, cross bar configurations, and hierarchical buses with bridges. The communication fabric 127 may also be packet-based, and may be hierarchical with bridges, cross bar, point-to-point, or other interconnects.

It is noted that the number of components of the SOC 110 (and the number of subcomponents for those shown in FIG. 1, such as within the CPU complex 114) may vary from embodiment to embodiment. There may be more or fewer of each component/subcomponent than the number shown in FIG. 1. It is also noted that SOC 110 may include many other components not shown in FIG. 1. In various embodiments, SOC 110 may also be referred to as an integrated circuit (IC), an application specific integrated circuit (ASIC), or an apparatus.

Figure 2:
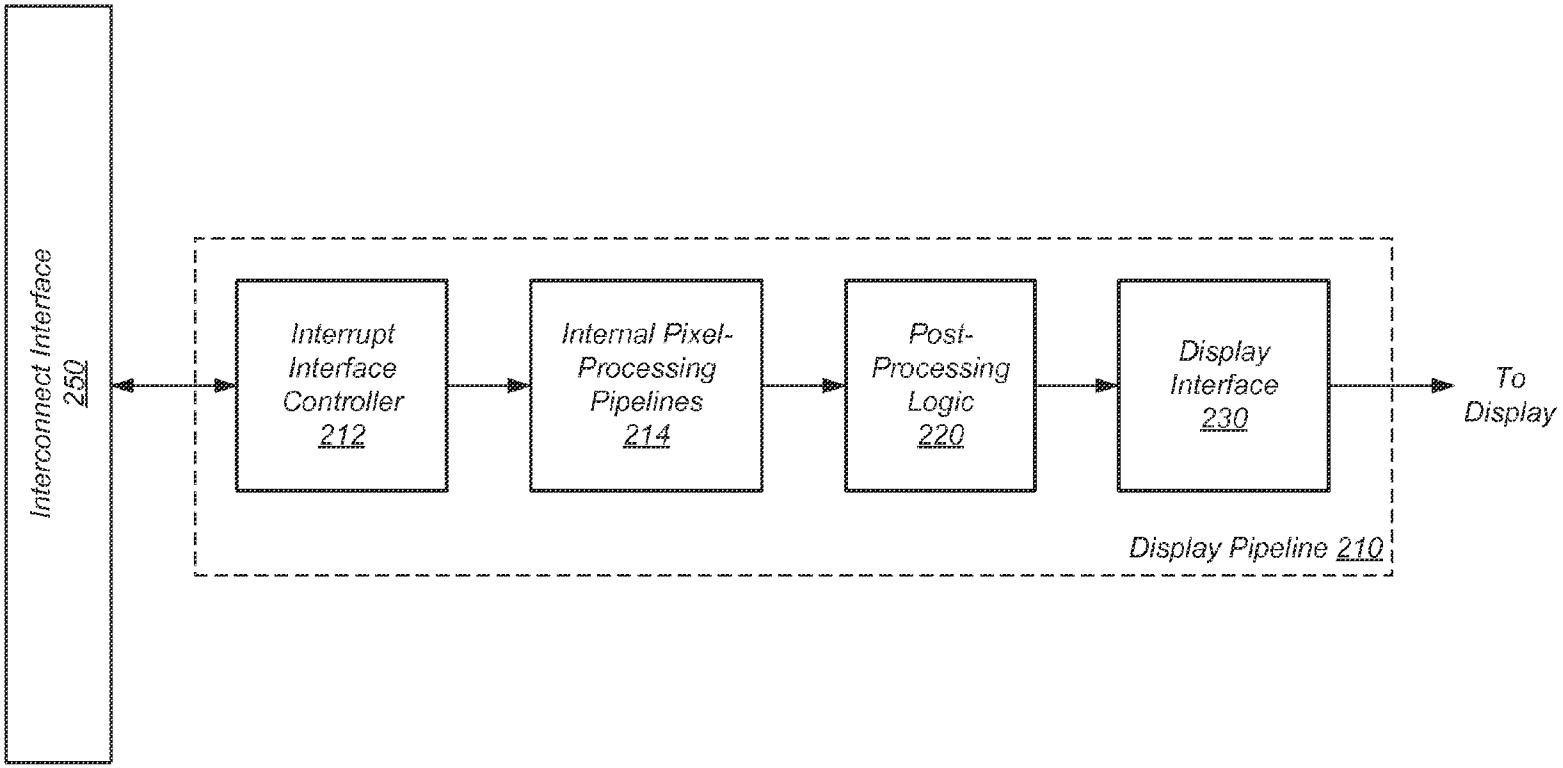
FIG. 2 is a block diagram of one embodiment of a display pipeline for use in an SOC.

Turning now to FIG. 2, a generalized block diagram of one embodiment of a display pipeline for use in an SoC is shown. Although one display pipeline is shown, in other embodiments, the host SOC (e.g., SOC 110) may include multiple display pipelines. Generally speaking, display pipeline 210 may be configured to process a source image and send rendered graphical information to a display (not shown).

Display pipeline 210 may be coupled to interconnect interface 250 which may include multiplexers and control logic for routing signals and packets between the display pipeline 210 and a top-level fabric. The interconnect interface 250 may correspond to communication fabric 127 of FIG. 1. Display pipeline 210 may include interrupt interface controller 212. Interrupt interface controller 212 may include logic to expand a number of sources or external devices to generate interrupts to be presented to the internal pixel-processing pipelines 214. The controller 212 may provide encoding schemes, registers for storing interrupt vector addresses, and control logic for checking, enabling, and acknowledging interrupts. The number of interrupts and a selected protocol may be configurable.

Display pipeline 210 may include one or more internal pixel-processing pipelines 214. The internal pixel-processing pipelines 214 may include one or more ARGB (Alpha, Red, Green, Blue) pipelines for processing and displaying user interface (UI) layers. The internal pixel-processing pipelines 214 may also include one or more pipelines for processing and displaying video content such as YUV content. In some embodiments, internal pixel-processing pipelines 214 may include blending circuitry for blending graphical information before sending the information as output to post-processing logic 220.

A layer may refer to a presentation layer. A presentation layer may consist of multiple software components used to define one or more images to present to a user. The UI layer may include components for at least managing visual layouts and styles and organizing browses, searches, and displayed data. The presentation layer may interact with process components for orchestrating user interactions and also with the business or application layer and the data access layer to form an overall solution. The YUV content is a type of video signal that consists of one signal for luminance or brightness and two other signals for chrominance or colors. The YUV content may replace the traditional composite video signal. For example, the MPEG-2 encoding system in the DVD format uses YUV content. The internal pixel-processing pipelines 214 may handle the rendering of the YUV content.

The display pipeline 210 may include post-processing logic 220. The post-processing logic 220 may be used for color management, ambient-adaptive pixel (AAP) modification, dynamic backlight control (DPB), panel gamma correction, and dither. The display interface 230 may handle the protocol for communicating with the display. For example, in one embodiment, a DisplayPort interface may be used. Alternatively, the Mobile Industry Processor Interface (MIPI) Display Serial Interface (DSI) specification or a 4-lane Embedded Display Port (eDP) specification may be used. It is noted that the post-processing logic and display interface may be referred to as the display backend.

Figure 3:
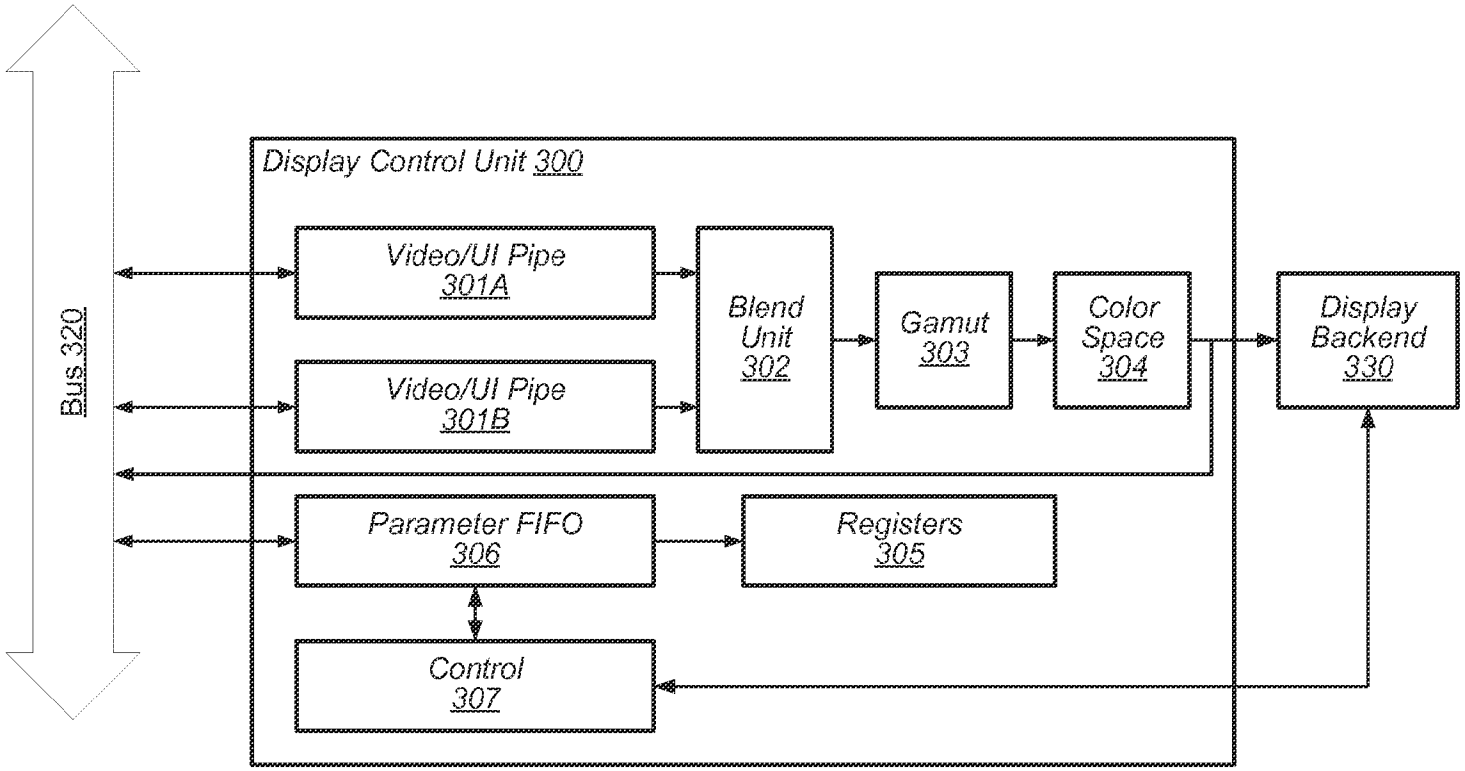
FIG. 3 is a block diagram illustrating one embodiment of a display control unit.

Referring now to FIG. 3, a block diagram of one embodiment of a display control unit 300 is shown. Display control unit 300 may represent the frontend portion of display pipe 116 of FIG. 1. Display control unit 300 may be coupled to a system bus 320 and to a display backend 330. In some embodiments, display backend 330 may directly interface to the display to display pixels generated by display control unit 300. Display control unit 300 may include functional sub-blocks such as one or more video/user interface (UI) pipelines 301A-B, blend unit 302, gamut adjustment block 303, color space converter 304, registers 305, parameter First-In First-Out buffer (FIFO) 306, and control unit 307. Display control unit 300 may also include other components which are not shown in FIG. 3 to avoid cluttering the figure.

System bus 320, in some embodiments, may correspond to communication fabric 127 from FIG. 1. System bus 320 couples various functional blocks such that the functional blocks may pass data between one another. Display control unit 300 may be coupled to system bus 320 in order to receive video frame data for processing. In some embodiments, display control unit 300 may also send processed video frames to other functional blocks and/or memory that may also be coupled to system bus 320. It is to be understood that when the term "video frame" is used, this is intended to represent any type of frame, such as an image, that can be rendered to the display.

The display control unit 300 may include one or more video/UI pipelines 301A-B, each of which may be a video and/or user interface (UI) pipeline depending on the embodiment. It is noted that the terms "video/UI pipeline" and "pixel processing pipeline" may be used interchangeably herein. In other embodiments, display control unit 300 may have one or more dedicated video pipelines and/or one or more dedicated UI pipelines. Each video/UI pipeline 301 may fetch a source image (or a portion of a source image) from a buffer coupled to system bus 320. The buffered source image may reside in a system memory such as, for example, system memory 112 from FIG. 1. Each video/UI pipeline 301 may fetch a distinct source image (or a portion of a distinct source image) and may process the source image in various ways, including, but not limited to, format conversion (e.g., YCbCr to ARGB), image scaling, and dithering. In some embodiments, each video/UI pipeline may process one pixel at a time, in a specific order from the source image, outputting a stream of pixel data, and maintaining the same order as pixel data passes through.

In one embodiment, when utilized as a user interface pipeline, a given video/UI pipeline 301 may support programmable active regions in the source image. The active regions may define the only portions of the source image to be displayed. In an embodiment, the given video/UI pipeline 301 may be configured to only fetch data within the active regions. Outside of the active regions, dummy data with an alpha value of zero may be passed as the pixel data.

Control unit 307 may, in various embodiments, be configured to arbitrate read requests to fetch data from memory from video/UI pipelines 301A-B. In some embodiments, the read requests may point to a virtual address. A memory management unit (not shown) may convert the virtual address to a physical address in memory prior to the requests being presented to the memory. In some embodiments, control unit 307 may include a dedicated state machine or sequential logic circuit. A general purpose processor executing program instructions stored in memory may, in other embodiments, be employed to perform the functions of control unit 307.

Blending unit 302 may receive a pixel stream from one or more of video/UI pipelines 301A-B. If only one pixel stream is received, blending unit 302 may simply pass the stream through to the next sub-block. However, if more than one pixel stream is received, blending unit 302 may blend the pixel colors together to create an image to be displayed. In various embodiments, blending unit 302 may be used to transition from one image to another or to display a notification window on top of an active application window. For example, a top layer video frame for a notification, such as, for a calendar reminder, may need to appear on top of, i.e., as a primary element in the display, despite a different application, an internet browser window for example. The calendar reminder may comprise some transparent or semi-transparent elements in which the browser window may be at least partially visible, which may require blending unit 302 to adjust the appearance of the browser window based on the color and transparency of the calendar reminder. The output of blending unit 302 may be a single pixel stream composite of the one or more input pixel streams.

The output of blending unit 302 may be sent to gamut adjustment unit 303. Gamut adjustment 303 may adjust the color mapping of the output of blending unit 302 to better match the available color of the intended target display. The output of gamut adjustment unit 303 may be sent to color space converter 304. Color space converter 304 may take the pixel stream output from gamut adjustment unit 303 and convert it to a new color space. Color space converter 304 may then send the pixel stream to display backend 330 or back onto system bus 320. In other embodiments, the pixel stream may be sent to other target destinations. For example, the pixel stream may be sent to a network interface for example. In some embodiments, a new color space may be chosen based on the mix of colors after blending and gamut corrections have been applied. In further embodiments, the color space may be changed based on the intended target display.

Display backend 330 may control the display to display the pixels generated by display control unit 300. Display backend 330 may read pixels at a regular rate from an output FIFO (not shown) of display control unit 300 according to a pixel clock. The rate may depend on the resolution of the display as well as the refresh rate of the display. For example, a display having a resolution of N×M and a refresh rate of R fps may have a pixel clock frequency based on N×M×R. On the other hand, the output FIFO may be written to as pixels are generated by display control unit 300.

Display backend 330 may receive processed image data as each pixel is processed by display control unit 300. Display backend 330 may provide final processing to the image data before each video frame is displayed. In some embodiments, display back end may include ambient-adaptive pixel (AAP) modification, dynamic backlight control (DPB), display panel gamma correction, and dithering specific to an electronic display coupled to display backend 330.

The parameters that display control unit 300 may use to control how the various sub-blocks manipulate the video frame may be stored in control registers 305. These registers may include, but are not limited to, setting the frame refresh rate, setting input and output frame sizes, setting input and output pixel formats, location of the source frames, and destination of the output (display backend 330 or system bus 320). Control registers 305 may be loaded by parameter FIFO 306.

Parameter FIFO 306 may be loaded by a host processor, a direct memory access unit, a graphics processing unit, or any other suitable processor within the computing system. In other embodiments, parameter FIFO 306 may directly fetch values from a system memory, such as, for example, system memory 112 in FIG. 1. Parameter FIFO 306 may be configured to update control registers 305 of display processor 300 before each source video frame is fetched. In some embodiments, parameter FIFO may update all control registers 305 for each frame. In other embodiments, parameter FIFO may be configured to update subsets of control registers 305 including all or none for each frame. A FIFO as used and described herein, may refer to a memory storage buffer in which data stored in the buffer is read in the same order it was written. A FIFO may be comprised of RAM or registers and may utilize pointers to the first and last entries in the FIFO.

It is noted that the display control unit 300 illustrated in FIG. 3 is merely an example. In other embodiments, different functional blocks and different configurations of functional blocks may be possible depending on the specific application for which the display pipeline is intended. For example, more than two video/UI pipelines may be included within a display pipeline frontend in other embodiments.

Figure 4:
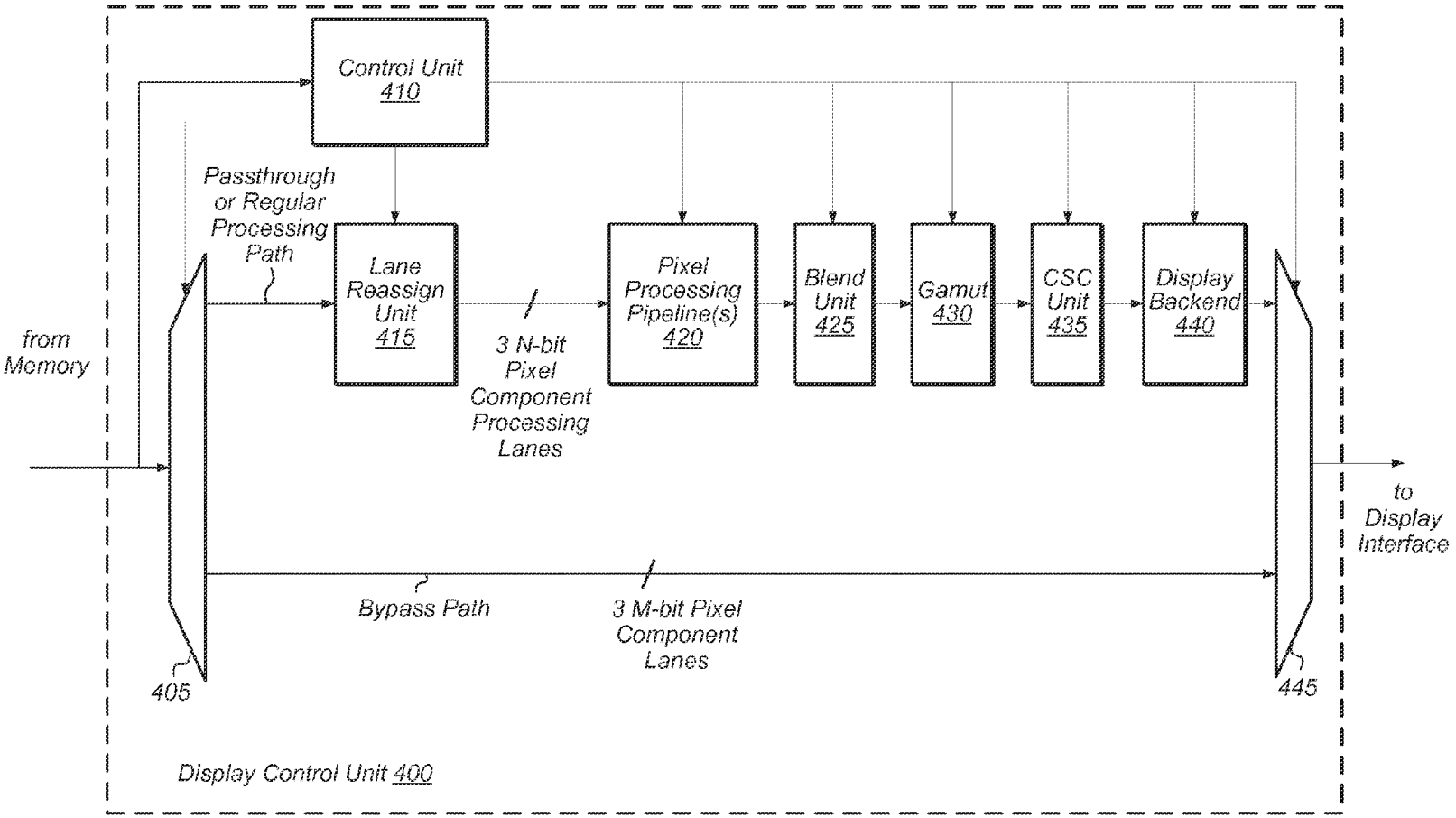
FIG. 4 is a block diagram illustrating another embodiment of a display control unit.

Turning now to FIG. 4, a block diagram of another embodiment of a display control unit 400 is shown. Display control unit 400 may represent display pipe 116 included in SoC 110 of FIG. 1. Display control unit 400 may be configured to receive source pixel data from memory (not shown) and process the source pixel data. The received source pixel data may be received in any of a variety of formats and any of a variety of bit-widths. In various embodiments, processing units within the display control unit 400 may be configured to process or not process the received source pixel data based on the format of the received data. For example, the format may correspond to RGB, ARGB, YCbCr 4:4:4, YCbCr 4:2:2, YCbCr 4:2:0. Additionally, the bit-width (e.g., 8 bits, 10 bits, 12 bits, 16 bits) of each pixel component (i.e., red pixel, green pixel, blue pixel, luma pixel, chroma blue-difference pixel, chroma red-difference pixel) of the received source pixel data may vary. Display control unit 400 may also be configured to route the received source pixel data on different paths based on the type of format and the bit-width of the received source pixel data.

The top path through display control unit 400 may be utilized as the passthrough path or the regular processing path, depending on the type of format and the bit-width of the received source pixel data. This passthrough or regular processing path may include 3 N-bit pixel component processing lanes. In one embodiment, 'N' may be 10, and the processing elements of display control unit 400 may be configured to process three separate 10-bit pixel components. In other embodiments, 'N' may be any of various other values. In some cases, there may be a fourth pixel component processing lane for a portion of the display pipeline, and this fourth pixel component processing lane may be utilized for processing the alpha component for formats (e.g., ARGB) which include the alpha component. However, the alpha component may be blended out by blend unit 425, and only three N-bit pixel components may be passed out of display control unit 400 to the display interface. The bottom path through display control unit 400 may be utilized as the bypass path, and the bypass path may include 3 M-bit pixel component lanes, wherein 'M' is greater than 'N'.

Control unit 410 may send control signals to the processing elements (e.g., units 415-440) of display control unit 400 to configure these elements to perform regular processing or to pass the data through unmodified. In some cases, one or more elements may perform regular processing while one or more elements may pass the data through unmodified. For example, regular processing may be performed in most elements but color space conversion (CSC) unit 435 may pass through the data unmodified if a color space conversion is not needed for the received source pixel data.

Control unit 410 may be configured to determine the type of format and bit-width of the received source pixel data. In one embodiment, control unit 410 may determine the format and bit-width from a corresponding packet in the parameter FIFO (e.g., parameter FIFO 306 of FIG. 3). In another embodiment, display control unit 400 may not distinguish between different source formats but instead software (and/or some other component(s)) executing on one or more processors (e.g., CPUs 128 of FIG. 1) may detect the different source formats and notify display control unit 400. For example, in one embodiment, display control unit 400 may be notified by software that both the passthrough format and non-passthrough format are the ARGB-8888 format. In this embodiment, software may realign the pixel data stored in memory such that when the pixel data is fetched by display control unit 400, the pixel data will map to the appropriate bits of the pixel component processing lanes. The display control unit 400 may be configured to bypass all internal logic for the passthrough format in this embodiment, so that the display control unit 400 passes the YCbCr 4:2:2 source data mapped across the 24 bits of the 8-bit RGB link channel outputs to the display interface.

In various embodiments, control unit 410 may route the source pixel data on separate paths (via demux 405) depending on the type of format and bit-width of the received source pixel data. For example, in one embodiment, if the received source pixel data has a bit-width less than or equal to 'N', the received source pixel data may be routed on the regular processing path through display control unit 400. The regular processing path may also be used as the passthrough path through display control unit 400.

Additionally, in one embodiment, if the received source pixel data has a bit-width greater than the bit-width of the pixel component processing lanes and the received source pixel data has not been subsampled, then the received source pixel data may be routed on the bypass path through display control unit 400. For example, if the received source pixel data is 12-bit YCbCr 4:4:4 and the pixel component processing lanes of display control unit 400 are 8-bits wide, then the received source pixel data may be routed on the bypass path through display control unit 400.

Still further, in one embodiment, if the received source pixel data has a bit-width greater than the bit-width of the pixel component processing lanes and the received source pixel data has been subsampled, then in some cases, the received source pixel data may be routed on the passthrough path through display control unit 400, and display control unit 400 may prevent the received source pixel data from being processed. For example, if the received source pixel data is 12-bit YCbCr 4:2:2 and the pixel processing lanes of display control unit 400 are 8-bits wide, then the received source pixel data may be routed on the passthrough path and remain unmodified. In this case, lane assign unit 415 may assign the source pixel components to the pixel component processing lanes of display control unit 400. One example of a assignment is shown in table 505 of FIG. 5.

Control unit 410 may control each of the units 420, 425, 430, 435, and 440 to either passthrough the received source pixel data unmodified or to process the data, depending on the type of format and bit-width of the received source pixel data. Pixel processing pipeline(s) 420, blend unit 425, gamut adjustment unit 430, CSC unit 435, and display backend 440 may allow received source pixel data to pass through the units unmodified when instructed to do so by control unit 410. For example, in one embodiment, CSC unit 435 may be configured to convert YCbCr data to RGB data. However, when YCbCr data is received and the YCbCr data meets the criteria for being passed through display control unit 400 unmodified, control unit 410 may notify CSC unit 435 that the received source pixel data is RGB data (even though the data is really YCbCr) to prevent a color space conversion from being performed.

In various embodiments, display backend 440 may include at least an ambient-adaptive pixel modifier unit, dynamic pixel brightness modification unit, dither unit, and/or one or more other units. Each of these units may be programmed by control unit 410 to either process the source pixel data or pass the source pixel data through unmodified. The passthrough or regular processing path and the bypass path may both be coupled to mux 445. Control unit 410 may select which input is coupled through to the output of mux 445, depending on which path is enabled, and then the output of mux 445 may be coupled to the display interface. Control unit 410 may inform the display interface which type of source pixel data is being conveyed so that the display interface may perform the appropriate type of processing on the received source pixel data.

Referring now to FIG. 5, one embodiment of an arrangement for assigning 12-bit YCbCr 4:2:2 to 8-bit RGB pixel component processing lanes is shown. Table 500 shows the typical 8-bit RGB pixel component processing lanes utilized by a display control unit (e.g., display control unit 300 of FIG. 3) for processing 8-bit source pixel data and for conveying 8-bit pixel components to the display interface. The 8-bit source pixel data may be received as YCbCr or RGB data. If the 8-bit source pixel data is received as YCbCr data, a color space conversion to the RGB space may be performed by a color space conversion unit (e.g., CSC unit 435 of FIG. 4).

In one embodiment, a display control unit may have three separate pixel component processing lanes which are coupled to the display. These three separate pixel component processing lanes may correspond to red, green, and blue pixel components. Each of these three pixel component processing lanes may be designed to accommodate pixel components of a given bit-width. If the source pixel data has a bit-width of less than or equal to this given bit-width, then the source pixel components may be assigned to the pixel component processing lanes on a one-to-one basis. If the source pixel data is less than the given bit-width, then the source pixel data may be assigned to the lower bit lanes of the pixel component processing lanes, leaving one or more of the most significant bit lanes unused. Otherwise, if the source pixel data has a bit-width greater than the given bit-width, then the source pixel components may be assigned to the pixel component processing lanes. In one embodiment, the assignment may entail assigning a first source pixel component to both a first pixel component processing lane and a first portion of a second pixel component processing lane. In this embodiment, the assignment may also entail assigning a second source pixel component to both a second portion of the second pixel component processing lane and to a third pixel component processing lane.

In one embodiment, the display control unit may receive 12-bit YCbCr 4:2:2 source pixel data components. The designation as 4:2:2 data indicates that the YCbCr has been subsampled. For 4:2:2 YCbCr source data, each pixel will have a luma (or Y) component and a chroma (Cx) component, with the Cb and Cr components alternating on consecutive pixels. In one embodiment, the display control unit may assign the upper bits [11:4] of the luma component to the green pixel component processing lanes, the display control unit may assign the lower bits [3:0] of the luma component to the lower bits [3:0] of the blue pixel component processing lanes, the display control unit may assign the upper bits [11:4] of the chroma component to the red pixel component processing lanes, and the display control unit may assign the lower bits [3:0] of the chroma component to the upper bits [7:4] of the blue pixel component processing lanes. These assignments are shown in table 505. It is noted that this is merely one example of a technique for assigning received source pixel components to the pixel component processing lanes of the display control unit. In other embodiments, other arrangements for assigning the received source pixel components to the pixel component processing lanes may be utilized. For example, in another embodiment, the pixel component processing lanes may support 10-bit source pixel components, and the received source pixel components may have a bit-width of 14 bits or higher. Other types of source pixel component to pixel component processing lane assignments are possible and are contemplated.

Figure 6:
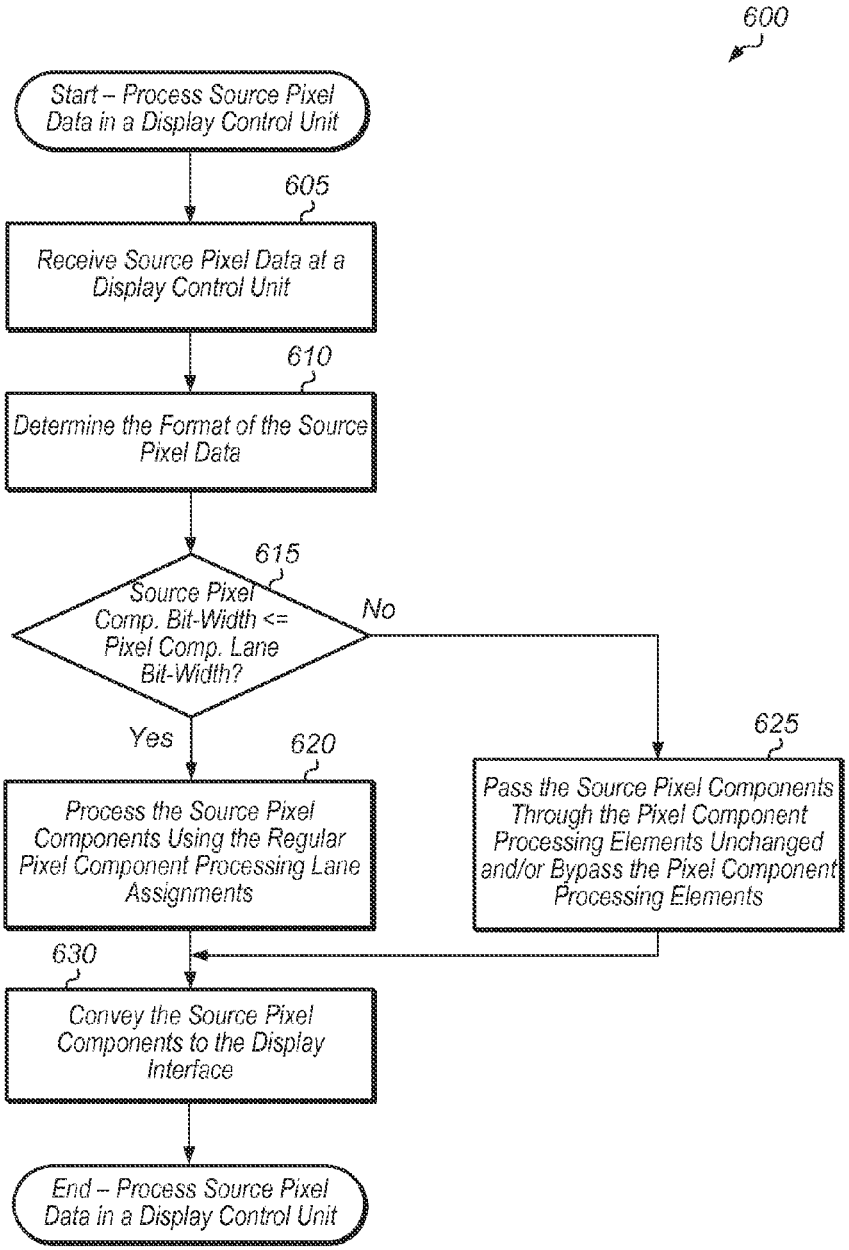
FIG. 6 is a generalized flow diagram illustrating one embodiment of a method for processing source pixel data in a display control unit.

Referring now to FIG. 6, one embodiment of a method 600 for processing source pixel data in a display control unit is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired. Any of the various systems, apparatuses, and/or display control units described herein may be configured to implement method 600.

A display control unit of a host apparatus may be configured to receive source pixel data (block 605). The display control unit may be coupled to a memory (via a communication fabric), and the display control unit may be coupled to a display (via a display interface). Depending on the embodiment, the host apparatus may be a mobile device (e.g., tablet, smartphone), wearable device, computer, or other computing device. Next, the display control unit may determine the format of the source pixel data (block 610). For example, the display control unit may determine if the source pixel data is in the ARGB, RGB, or YCbCr format, the number of bits per pixel component, if the source pixel data is subsampled, and/or one or more other characteristics.

If the bit-width of the source pixel components is less than or equal to the bit-width of the display control unit pixel component processing lanes (conditional block 615, "yes" leg), then the display control unit may process the source pixel components using the regular pixel component processing lane assignments (block 620). In one embodiment, there may be three source pixel components and three pixel component processing lanes, and each source pixel component may be assigned to a corresponding pixel component processing lane using the regular lane assignments (i.e., as shown in table 500 of FIG. 5). If the bit-width of the source pixel components is greater than the bit-width of the display control unit processing lanes (conditional block 615, "no" leg), then the display control unit may pass the source pixel components through the pixel component processing elements unchanged and/or bypass the pixel component processing elements (block 625). It is noted that the display control unit may utilize both approaches, with the source pixel components passing through some pixel component processing elements unchanged and the source pixel components bypassing other pixel component processing elements. A further discussion regarding how to determine which approach (passthrough or bypass) to use is described in further detail in FIG. 7. Next, after blocks 620 and 625, the display control unit may convey the source pixel components to the display interface (block 630). After block 630, method 600 may end.

Figure 7:
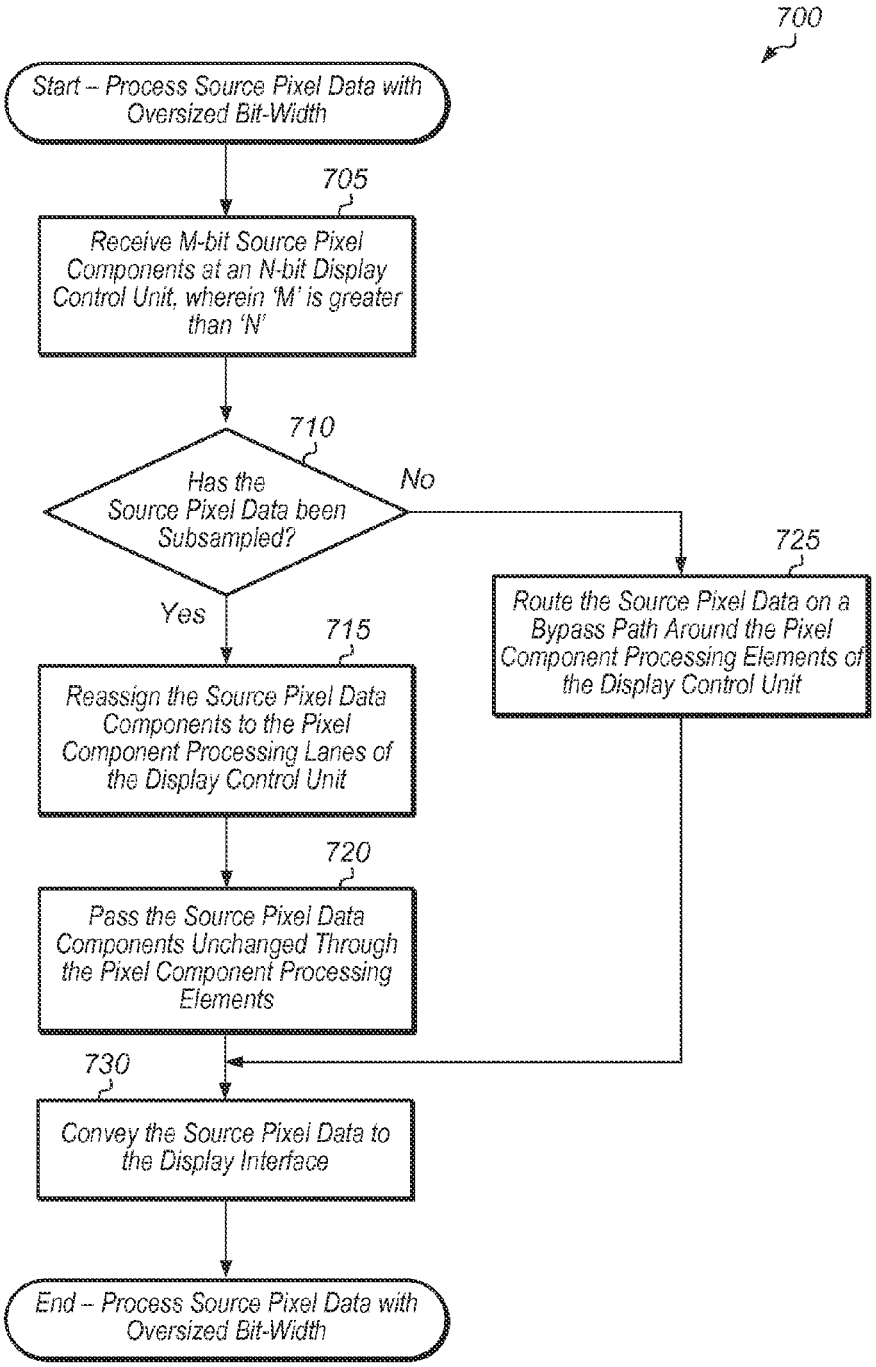
FIG. 7 is a generalized flow diagram illustrating one embodiment of a method for processing source pixel data with oversized bit-width.

Turning now to FIG. 7, one embodiment of a method 700 for processing source pixel data with oversized bit-width is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired. Any of the various systems, apparatuses, and display control units described herein may be configured to implement method 700.

A display control unit may receive M-bit source pixel components, wherein the display control unit has pixel component processing elements designed to handle N-bit source pixel components, wherein 'M' is greater than 'N' (block 705). Next, the display control unit may determine if the source pixel data has been subsampled (conditional block 710). For example, if the source pixel data is 4:2:2 or 4:2:0 YCbCr data, then the display control unit may identify the source pixel components as being subsampled.

If the source pixel data has been subsampled (conditional block 710, "yes" leg), then the display control unit may assign the source pixel data components to the pixel component processing lanes of the display control unit (block 715). For example, in one embodiment, if the source pixel data is 4:2:2 YCbCr data, then the luma component may be assigned to the green and a first portion of the blue pixel component processing lanes of the display control unit, and the chroma component may be assigned to the red and a second portion of the blue pixel component processing lanes of the display control unit. Other ways of assigning the source pixel components to the pixel component processing lanes of the display control unit may be utilized. After block 715, the source pixel data components may pass through the pixel component processing elements of the display control unit unchanged (block 720).

If the source pixel data has not been subsampled (conditional block 710, "no" leg), then the display control unit may route the source pixel data on a bypass path around the pixel component processing elements of the display control unit (block 725). After blocks 720 and 725, the source pixel data may be conveyed to the display interface (block 730). After block 730, method 700 may end.

Figure 8:
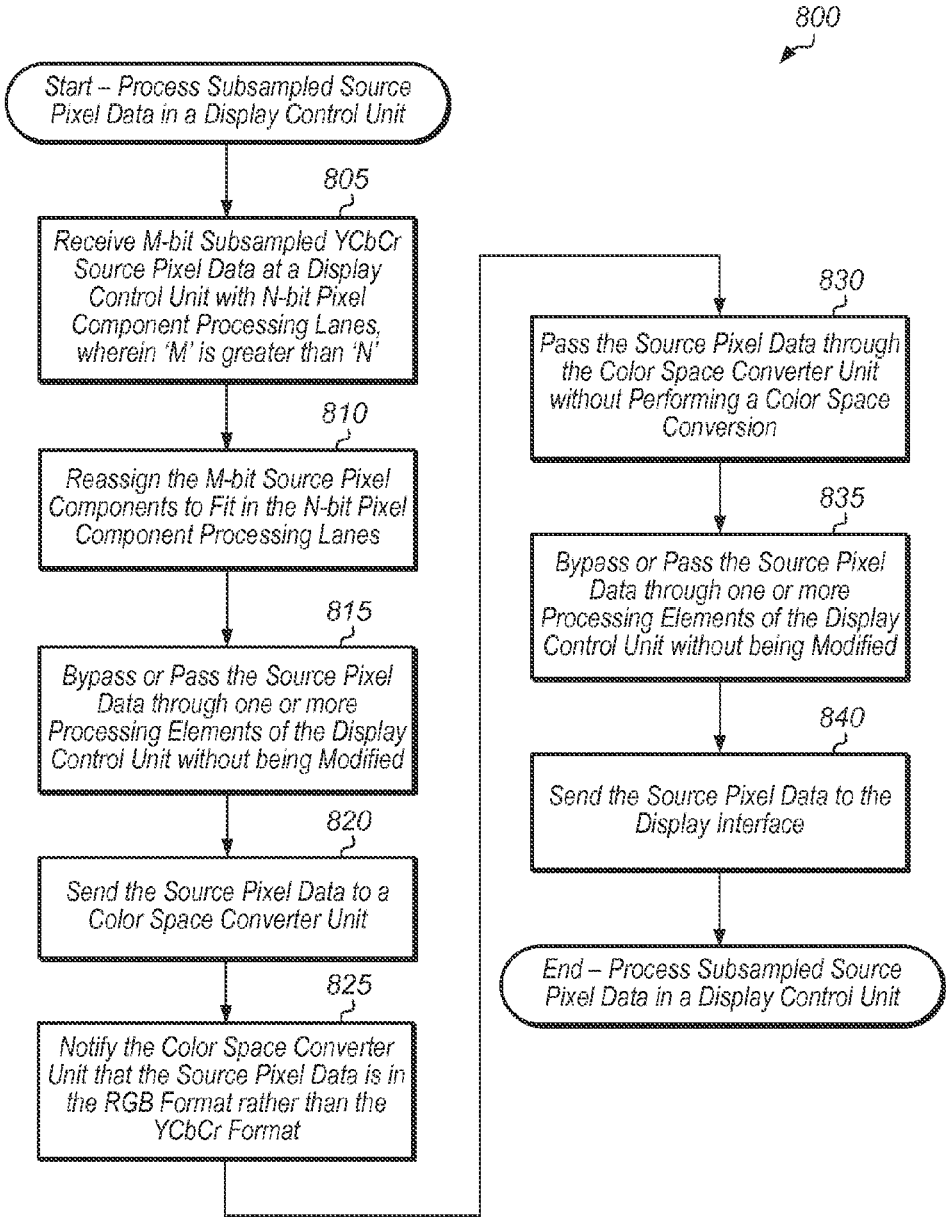
FIG. 8 is a generalized flow diagram illustrating one embodiment of a method for processing subsampled source pixel data in a display control unit.

Turning now to FIG. 8, one embodiment of a method 800 for processing subsampled source pixel data in a display control unit is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired. Any of the various systems, apparatuses, and display control units described herein may be configured to implement method 800.

A display control unit with N-bit pixel component processing lanes may receive M-bit subsampled YCbCr source pixel data for processing, wherein 'M' and 'N' are integers, and wherein 'M' is greater than 'N' (block 805). The display control unit may assign the M-bit subsampled YCbCr source pixel data to fit in the N-bit pixel component processing lanes (block 810). It is assumed for the purposes of this discussion that the M-bit subsampled YCbCr source pixel data is able to fit in the N-bit pixel component processing lanes. For embodiments where the M-bit subsampled YCbCr source pixel data is unable to fit in the N-bit pixel component processing lanes, the source pixel data may be routed on a bypass path through the display control unit.

After block 810, the display control unit may bypass or pass the source pixel data through one or more processing elements of the display control unit without being modified (block 815). Next, the subsampled YCbCr may be sent to a color space converter unit (block 820). In one embodiment, the color space converter unit may be configured to convert YCbCr to RGB data. The display control unit may notify the color space converter that the source pixel data is in the RGB format rather than the YCbCr format (block 825). In response, the color space converter may pass the source pixel data through without performing a color space conversion on the source pixel data (block 830). If the color space converter were notified that the source pixel data was actually YCbCr data, then the color space converter would try to perform a YCbCr to RGB conversion on the data. However, since the source pixel component data is M-bits wide and the pixel component processing lanes are only N-bits wide, the color space converter would not be able to perform a proper conversion on the data. Therefore, the display control unit may characterize the data as being in the RGB color space even though the data is really in the YCbCr color space.

After block 830, the source pixel data may bypass or passthrough one or more processing elements without being modified (block 835). Then, the source pixel data may be sent to the display interface (block 840). After block 840, method 800 may end.

Figure 9:
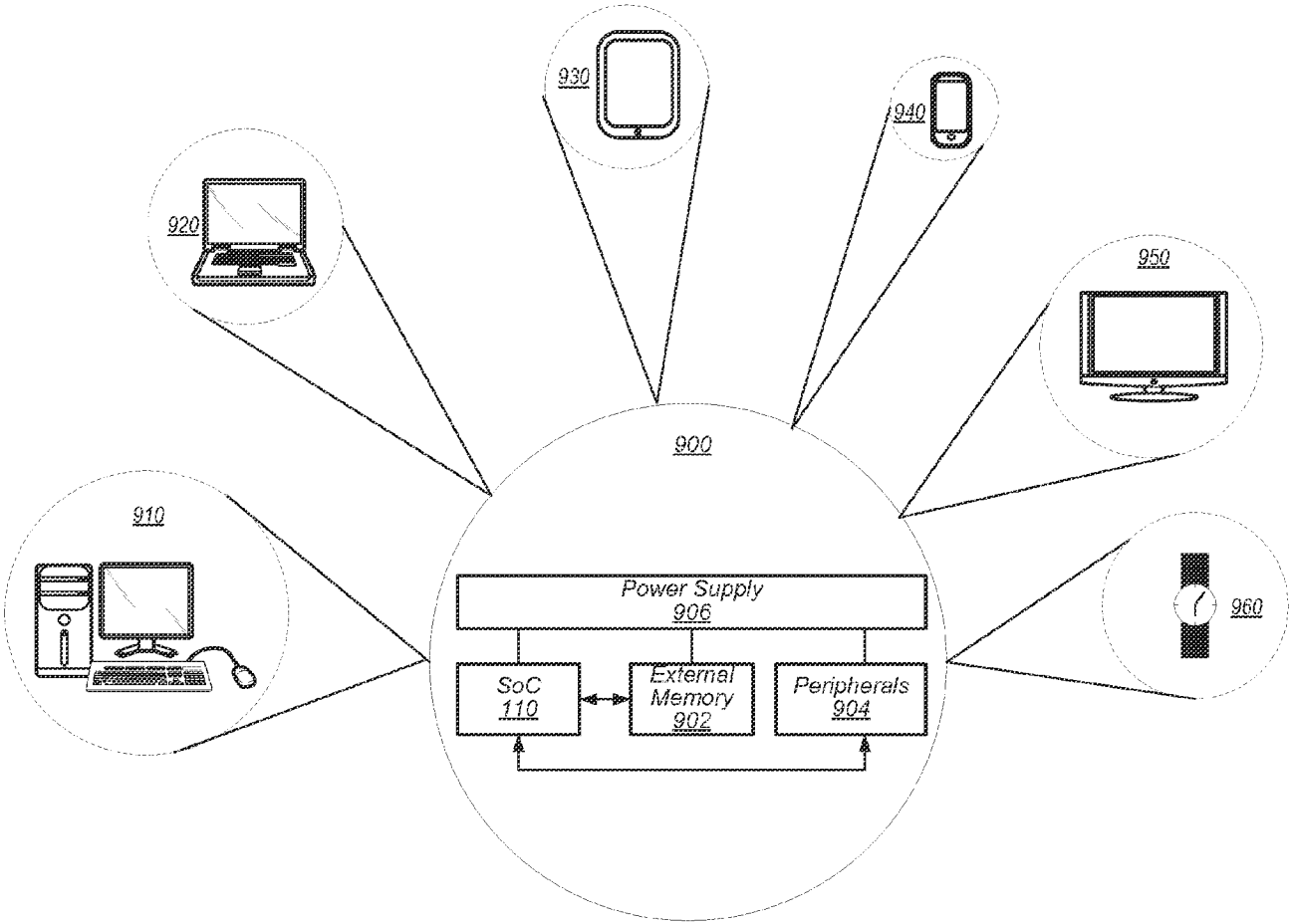
FIG. 9 is a block diagram of one embodiment of a system.

Referring next to FIG. 9, a block diagram of one embodiment of a system 900 is shown. As shown, system 900 may represent chip, circuitry, components, etc., of a desktop computer 910, laptop computer 920, tablet computer 930, cell phone 940, television 950 (or set top box configured to be coupled to a television), wrist watch or other wearable item 960, or otherwise. Other devices are possible and are contemplated. In the illustrated embodiment, the system 900 includes at least one instance of SoC 110 (of FIG. 1) coupled to an external memory 902.

SoC 110 is coupled to one or more peripherals 904 and the external memory 902. A power supply 906 is also provided which supplies the supply voltages to SoC 110 as well as one or more supply voltages to the memory 902 and/or the peripherals 904. In various embodiments, power supply 906 may represent a battery (e.g., a rechargeable battery in a smart phone, laptop or tablet computer). In some embodiments, more than one instance of SoC 110 may be included (and more than one external memory 902 may be included as well).

The memory 902 may be any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., and/or low power versions of the SDRAMs such as LPDDR2, etc.), RAMBUS DRAM (RDRAM), static RAM (SRAM), etc. One or more memory devices may be coupled onto a circuit board to form memory modules such as single inline memory modules (SIMMs), dual inline memory modules (DIMMs), etc. Alternatively, the devices may be mounted with SoC 110 in a chip-on-chip configuration, a package-on-package configuration, or a multi-chip module configuration.

The peripherals 904 may include any desired circuitry, depending on the type of system 900. For example, in one embodiment, peripherals 904 may include devices for various types of wireless communication, such as wifi, Bluetooth, cellular, global positioning system, etc. The peripherals 904 may also include additional storage, including RAM storage, solid state storage, or disk storage. The peripherals 904 may include user interface devices such as a display screen, including touch display screens or multitouch display screens, keyboard or other input devices, microphones, speakers, etc.

In various embodiments, program instructions of a software application may be used to implement the methods and/or mechanisms previously described. The program instructions may describe the behavior of hardware in a high-level programming language, such as C. Alternatively, a hardware design language (HDL) may be used, such as Verilog. The program instructions may be stored on a non-transitory computer readable storage medium. Numerous types of storage media are available. The storage medium may be accessible by a computer during use to provide the program instructions and accompanying data to the computer for program execution. In some embodiments, a synthesis tool reads the program instructions in order to produce a netlist comprising a list of gates from a synthesis library.

It should be emphasized that the above-described embodiments are only non-limiting examples of implementations. Numerous variations and modifications will become apparent to those skilled in the art once the above disclosure is fully appreciated. It is intended that the following claims be interpreted to embrace all such variations and modifications.

What is claimed is:

1. A display control unit comprising:

a plurality of pixel component processing lanes, each lane configured to support data of a first bit-width; and circuitry configured to:

receive source pixel data;

determine whether each source pixel of the source pixel data comprises a first bit-width or a second bit-width, wherein the second bit-width is greater than the first bit-width;

responsive to determining each source pixel of the source pixel data comprises the first bit-width, assign each source pixel component of the source pixel data to a single pixel component processing lane of the plurality of pixel component processing lanes; and responsive to determining each source pixel of the source pixel data comprises the second bit-width, assign a first source pixel component of the source pixel data to at least a portion of two separate pixel component processing lanes of the plurality of pixel component processing lanes.

2. The display control unit as recited in claim 1, wherein responsive to determining each source pixel of the source pixel data comprises the first bit-width, the display control unit is further configured to modify at least a portion of the source pixel data.

3. The display control unit as recited in claim 2, wherein responsive to determining each source pixel of the source pixel data comprises the second bit-width, the display control unit is further configured to pass the source pixel data through the display control unit without modifying the source pixel data.

4. The display control unit as recited in claim 1, wherein the display control unit is configured to assign a first source pixel component of the source pixel data to at least a portion of two separate pixel component processing lanes in further response to determining the source pixel data is subsampled.

5. The display control unit as recited in claim 4, wherein the source pixel data is in a YCbCr 4:2:2 format, and wherein the second bit-width is greater than a bit-width of each pixel component processing lane.

6. The display control unit as recited in claim 1, wherein the first source pixel component is a luma pixel component, and wherein the two separate pixel component processing lanes are a blue pixel component processing lane and a green pixel component processing lane.

7. The display control unit as recited in claim 6, wherein responsive to determining each source pixel of the source pixel data comprises the second bit-width, the display control unit is further configured to assign a first portion of a chroma pixel component to at least a portion of the blue pixel component processing lane and a second portion of the chroma pixel component to at least a portion of a red pixel component processing lane.

8. A computing system comprising:

a display device; and a display control unit coupled to the display device, wherein the display control unit comprises circuitry configured to:

receive source pixel data;

determine whether each source pixel of the source pixel data comprises a first bit-width or a second bit-width, wherein the second bit-width is greater than the first bit-width;

responsive to determining each source pixel of the source pixel data comprises the first bit-width, assign each source pixel component of the source pixel data to a single pixel component processing lane of the plurality of pixel component processing lanes; and responsive to determining each source pixel of the source pixel data comprises the second bit-width, assign a first source pixel component of the source pixel data to at least a portion of two separate pixel component processing lanes of the plurality of pixel component processing lanes.

9. The computing system as recited in claim 8, wherein responsive to determining each source pixel of the source pixel data comprises the first bit-width, the display control unit is further configured to modify at least a portion of the source pixel data.

10. The computing system as recited in claim 9, wherein responsive to determining each source pixel of the source pixel data comprises the second bit-width, the display control unit is further configured to pass the source pixel data through the display control unit without modifying the source pixel data.

11. The computing system as recited in claim 8, wherein the display control unit is configured to assign a first source pixel component of the source pixel data to at least a portion of two separate pixel component processing lanes in further response to determining the source pixel data is subsampled.

12. The computing system as recited in claim 11, wherein the source pixel data is in a YCbCr 4:2:2 format, and wherein the second bit-width is greater than a bit-width of each pixel component processing lane.

13. The computing system as recited in claim 8, wherein the first source pixel component is a luma pixel component, and wherein the two separate pixel component processing lanes are a blue pixel component processing lane and a green pixel component processing lane.

14. The computing system as recited in claim 13, wherein responsive to determining each source pixel of the source pixel data comprises the second bit-width, the display control unit is further configured to assign a first portion of a chroma pixel component to at least a portion of the blue pixel component processing lane and a second portion of the chroma pixel component to at least a portion of a red pixel component processing lane.

15. A method comprising:

receiving source pixel data at a display control unit;

responsive to determining each source pixel of the source pixel data comprises the first bit-width, circuitry assigning each source pixel component of the source pixel data to a single pixel component processing lane of a plurality of pixel component processing lanes; and responsive to determining each source pixel of the source pixel data comprises the second bit-width, circuitry assigning a first source pixel component of the source pixel data to at least a portion of two separate pixel component processing lanes of the plurality of pixel component processing lanes.

16. The method as recited in claim 15, wherein responsive to determining each source pixel of the source pixel data comprises the first bit-width, the method further comprising modifying at least a portion of the source pixel data.

17. The method as recited in claim 16, wherein responsive to determining each source pixel of the source pixel data comprises the second bit-width, the method further comprising passing the source pixel data through the display control unit without modifying the source pixel data.

18. The method as recited in claim 15, further comprising assigning a first source pixel component of the source pixel data to at least a portion of two separate pixel component processing lanes in further response to determining the source pixel data is subsampled.

19. The method as recited in claim 15, wherein the first source pixel component is a luma pixel component, and wherein the two separate pixel component processing lanes are a blue pixel component processing lane and a green pixel component processing lane.

20. The method as recited in claim 19, wherein responsive to determining each source pixel of the source pixel data comprises the second bit-width, the method further comprising assigning a first portion of a chroma pixel component to at least a portion of the blue pixel component processing lane and a second portion of the chroma pixel component to at least a portion of a red pixel component processing lane.

* * * * *